US009501969B2

(12) United States Patent
Kwon et al.

(10) Patent No.: US 9,501,969 B2
(45) Date of Patent: Nov. 22, 2016

(54) DC-DC CONVERTER AND ORGANIC LIGHT EMITTING DISPLAY INCLUDING THE SAME

(71) Applicant: Samsung Display Co., Ltd., Yongin, Gyeonggi-do (KR)

(72) Inventors: Oh-Jo Kwon, Yongin (KR); Hak-Sun Kim, Yongin (JP); Joo-Hyung Lee, Yongin (KR); Won-Tae Choi, Yongin (KR); Bo-Yeon Kim, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 801 days.

(21) Appl. No.: 13/629,425

(22) Filed: Sep. 27, 2012

(65) Prior Publication Data

US 2014/0022149 A1 Jan. 23, 2014

(30) Foreign Application Priority Data

Jul. 17, 2012 (KR) ..... 10-2012-0077784

(51) Int. Cl.
*G09G 3/30* (2006.01)
*G09G 3/32* (2016.01)

(52) U.S. Cl.
CPC .... *G09G 3/3233* (2013.01); *G09G 2300/0842* (2013.01); *G09G 2330/021* (2013.01); *G09G 2330/028* (2013.01)

(58) Field of Classification Search
CPC ..... G09G 3/3233; H02M 3/156
USPC ..... 345/6, 212, 213, 76, 690; 323/283
See application file for complete search history.

(56) References Cited

U.S. PATENT DOCUMENTS

2005/0017922 A1* 1/2005 Devos et al. ..... 345/6
2008/0284400 A1* 11/2008 Oettinger et al. ..... 323/283
2011/0115776 A1* 5/2011 Yun ..... H02J 7/0065 345/212

FOREIGN PATENT DOCUMENTS

KR 1020050051074 6/2005
KR 1020060039987 5/2006
KR 1020090054161 5/2009
KR 1020100097871 9/2010

* cited by examiner

*Primary Examiner* — Calvin C Ma
(74) *Attorney, Agent, or Firm* — Knobbe Martens Olson & Bear LLP

(57) ABSTRACT

There are disclosed a DC-DC converter and an organic light emitting display including the same. The DC-DC converter includes a first voltage generator that has an inductor and a plurality of transistors, and converts an input voltage into a first voltage and outputs the first voltage to a first output terminal. The DC-DC converter also includes a controller that controls driving of the first voltage generator by supplying a first driving pulse to each transistor of the first voltage generator. In the DC-DC converter, the amplitude of the first driving pulse is adjustable. Accordingly, it is possible to provide a DC-DC converter and an organic light emitting display including the same, which can achieve high power conversion efficiency by change a driving pulse used in a DC-DC converter.

24 Claims, 6 Drawing Sheets

DC-DC CONVERTER AND ORGANIC LIGHT EMITTING DISPLAY INCLUDING THE SAME

CROSS-REFERENCE TO RELATED APPLICATIONS

This application claims priority to and the benefit of Korean Patent Application No. 10-2012-0077784, filed on Jul. 17, 2012, in the Korean Intellectual Property Office, the entire content of which is incorporated herein by reference.

BACKGROUND

1. Field

An aspect of the present invention relates to a DC-DC converter and an organic light emitting display including the same, which can achieve high power conversion efficiency.

2. Description of the Related Technology

Recently, there have been developed various types of flat panel display devices capable of reducing the disadvantageous weight and volume of cathode ray tubes. Flat panel displays include a liquid crystal display (LCD), a field emission display (FED), a plasma display panel (PDP), an organic light emitting display (OLED), and the like.

Among these flat panel displays, the OLEDs display images using organic light emitting diodes that emit light through recombination of electrons and holes. The OLED has a fast response speed and is driven with low power consumption.

A typical OLED includes a DC-DC converter that converts external power into power required to drive the OLED.

Recently, as the OLED is employed in mobile devices and the like, interest in power conversion efficiency of the DC-DC converter has been increased.

SUMMARY OF CERTAIN INVENTIVE ASPECTS

Embodiments provide a DC-DC converter and an organic light emitting display including the same, which can achieve high power conversion efficiency by change a driving pulse used in a DC-DC converter.

Embodiments also provide a DC-DC converter and an organic light emitting display including the same, which can increase the use time of a battery by reducing power loss.

According to an aspect of the present invention, there is provided a DC-DC converter, including: a first voltage generator including a first inductor and a first plurality of transistors, and configured to convert an input voltage into a first voltage and to output the first voltage to a first output terminal; and a controller configured to control driving of the first voltage generator by supplying a first driving pulse to each transistor of the first voltage generator, wherein the amplitude of the first driving pulse is adjustable.

The first voltage generator may include a first inductor coupled between a first node and an input terminal to which the input voltage is applied; a first transistor coupled between the first node and ground; and a second transistor coupled between the first node and the first output terminal.

The controller may be configured to change the amplitude of the first driving pulse, based on the current output from the first voltage generator.

The controller may be configured to change the amplitude of the first driving pulse, based on the current output from the first voltage generator and further based on the input voltage.

The first driving pulse may be supplied to each of the gate electrodes of the first and second transistors, respectively.

The DC-DC converter may further include a second voltage generator including a second inductor and a second plurality of transistors, and configured to convert the input voltage into a second voltage and to output the second voltage to a second output terminal. The controller may be configured to control driving of the second voltage generator by supplying a second driving pulse to each transistor of the second voltage generator, and the amplitude of the second driving pulse may be adjustable.

The second voltage generator may include a third transistor coupled between a second node and the input terminal to which the input voltage is applied; a fourth transistor coupled between the second node and the second output terminal; and a second inductor coupled between the second node and ground.

The controller may be configured to change the amplitude of the second driving pulse, based on current output from the second voltage generator.

The controller may be configured to change the amplitude of the first driving pulse, based on current output from the second voltage generator and further based on the input voltage.

The second driving pulse may be supplied to each of the gate electrodes of the third and fourth transistors, respectively.

The first voltage generator may further include at least one first auxiliary transistor coupled in parallel to the first transistor; and at least one second auxiliary transistor coupled in parallel to the second transistor.

The second voltage generator may further include at least one third auxiliary transistor coupled in parallel to the third transistor; and at least one fourth auxiliary transistor coupled in parallel to the fourth transistor.

The controller may be configured to select at least one of the first transistor and the at least one first auxiliary transistor and to drive the selected transistor, and may be configured to select at least one of the second transistor and the at least one second auxiliary transistor and to drive the selected transistor.

The controller may be configured to select at least one of the third transistor and the at least one third auxiliary transistor and to drive the selected transistor, and may be configured to select at least one of the fourth transistor and the at least one fourth auxiliary transistor and to drive the selected transistor.

The first voltage may be a positive voltage and the second voltage may be a negative voltage.

According to an aspect of the present invention, there is provided an organic light emitting display, including: a plurality of pixels coupled to scan lines and data lines; a scan driver configured to supply a scan signal to the pixels through the scan lines; a data driver configured to supply a data signal to the pixels through the data lines; and a DC-DC converter configured to supply first and second voltages to the pixels, wherein the DC-DC converter includes a first voltage generator including a first inductor and a first plurality of transistors, the first voltage generator configured to convert an input voltage into a first voltage and to output the first voltage to a first output terminal, and a controller configured to control driving of the first voltage generator by supplying a first driving pulse to each transistor of the first voltage generator, where the amplitude of the first driving pulse is adjustable.

The first voltage generator may include a first inductor coupled between a first node and an input terminal to which the input voltage is applied; a first transistor coupled between the first node and ground; and a second transistor coupled between the first node and the first output terminal.

The controller may be configured to change the amplitude of the first driving pulse, based on current output from the first voltage generator.

The controller may be configured to change the amplitude of the first driving pulse, based on current output from the first voltage generator and the input voltage.

The first driving pulse may be supplied to each of the gate electrodes of the first and second transistors, respectively.

The DC-DC converter may further include a second voltage generator including a second inductor and a second plurality of transistors, the second voltage generator configured to convert the input voltage into a second voltage and to output the second voltage to a second output terminal, wherein the controller is further configured to control driving of the second voltage generator by supplying a second driving pulse to each transistor of the second voltage generator, and the amplitude of the second driving pulse is adjustable.

The second voltage generator may include a third transistor coupled between a second node and the input terminal to which the input voltage is applied; a fourth transistor coupled between the second node and the second output terminal; and a second inductor coupled between the second node and ground.

The controller may be configured to change the amplitude of the second driving pulse, based on current output from the second voltage generator.

The controller may be configured to change the amplitude of the first driving pulse, based on current output from the second voltage generator and further based on the input voltage.

The second driving pulse may be supplied to each of the gate electrodes of the third and fourth transistors, respectively.

The first voltage generator may further include at least one first auxiliary transistor coupled in parallel to the first transistor; and at least one second auxiliary transistor coupled in parallel to the second transistor.

The second voltage generator may further include at least one third auxiliary transistor coupled in parallel to the third transistor; and at least one fourth auxiliary transistor coupled in parallel to the fourth transistor.

The controller may be configured to select at least one of the first transistor and the first auxiliary transistor and to drive the selected transistor, and may be configured to select at least one of the second transistor and the second auxiliary transistor and to drive the selected transistor.

The controller may be configured to select at least one of the third transistor and the third auxiliary transistor and to drive the selected transistor, and may be configured to select at least one of the fourth transistor and the fourth auxiliary transistor and to drive the selected transistor.

The first voltage may be a positive voltage and the second voltage may be a negative voltage.

As described above, according to the present invention, it is possible to provide a DC-DC converter and an organic light emitting display including the same, which can achieve high power conversion efficiency by change a driving pulse used in a DC-DC converter.

Further, it is possible to provide a DC-DC converter and an organic light emitting display including the same, which can increase the use time of a battery by reducing power loss.

BRIEF DESCRIPTION OF THE DRAWINGS

The accompanying drawings, together with the specification, illustrate certain embodiments of the present invention, and, together with the description, serve to explain the principles of the present invention.

DETAILED DESCRIPTION OF CERTAIN INVENTIVE EMBODIMENTS

Figure 1:
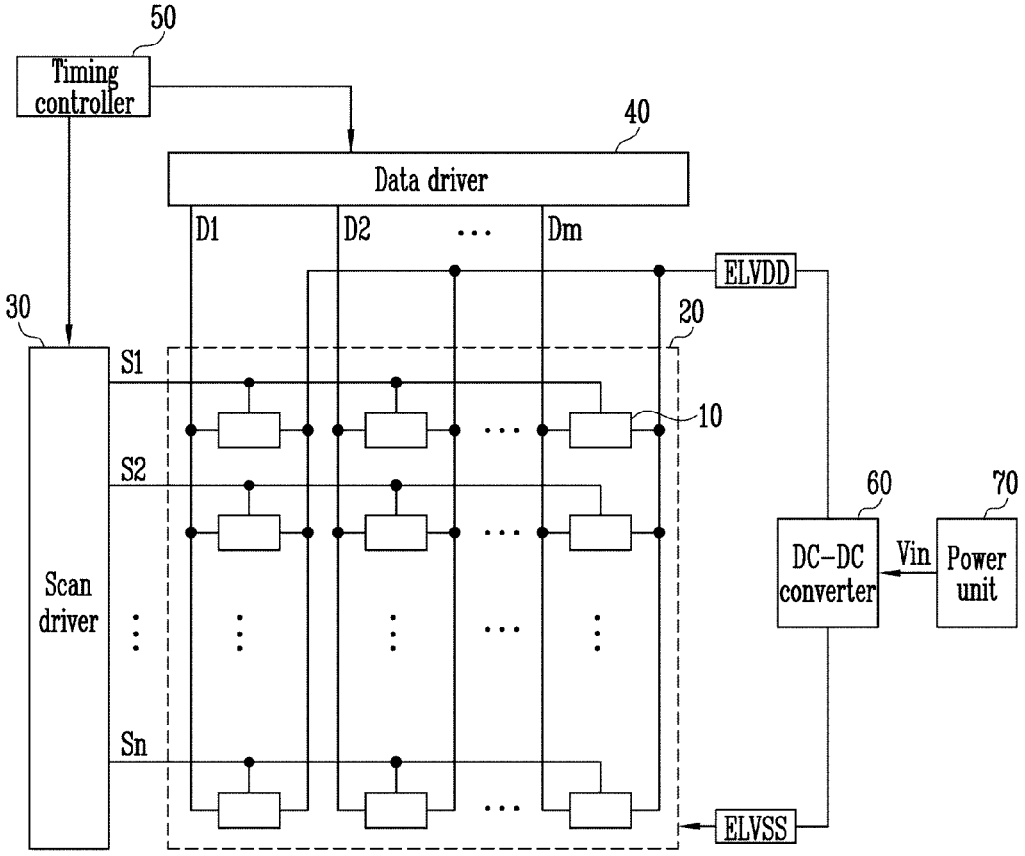
FIG. 1 is a diagram showing an organic light emitting display according to an embodiment of the present invention.

Hereinafter, certain embodiments according to the present invention will be described with reference to the accompanying drawings. When a first element is described as being coupled to a second element, the first element may be not only directly coupled to the second element, but may also be indirectly coupled to the second element via a third element. Further, the description of some of the elements that are not essential to the complete understanding of the invention may be omitted for clarity. Also, like reference numerals generally refer to like elements throughout.

Hereinafter, a DC-DC converter and an organic light emitting display according to embodiments of the present invention will be described with reference to the accompanying drawings.

FIG. 1 is a diagram showing an organic light emitting display according to an embodiment of the present invention.

Referring to FIG. 1, the organic light emitting display according to this embodiment includes a pixel unit 20 having a plurality of pixels 10 coupled to scan lines S1 to Sn and data lines D1 to Dm, a scan driver 30 that supplies a scan signal to each pixel 10 through the scan lines S1 to Sn, a data driver 40 that supplies a data signal to each pixel 10 through the data lines D1 to Dm, and a DC-DC converter 60 that supplies a first voltage ELVDD and a second voltage ELVSS to each pixel 10. The organic light emitting display may further include a timing controller 50 for controlling the scan driver 30 and the data driver 40.

Each pixel 10 generates light corresponding to the data signal by current flowing from the first voltage ELVDD to the second voltage ELVSS via an organic light emitting diode.

The scan driver 30 generates a scan signal under the control of the timing controller 50, and supplies the generated scan signal to the scan lines S1 to Sn.

The data driver 40 generates a data signal under the control of the timing controller 50, and supplies the generated data signal to the data lines D1 to Dm.

If the scan signal is progressively supplied to the scan lines S1 to Sn, pixels 10 are progressively selected for each line, and the selected pixels 10 receives the data signal provided from the data lines D1 to Dm.

Figure 2:
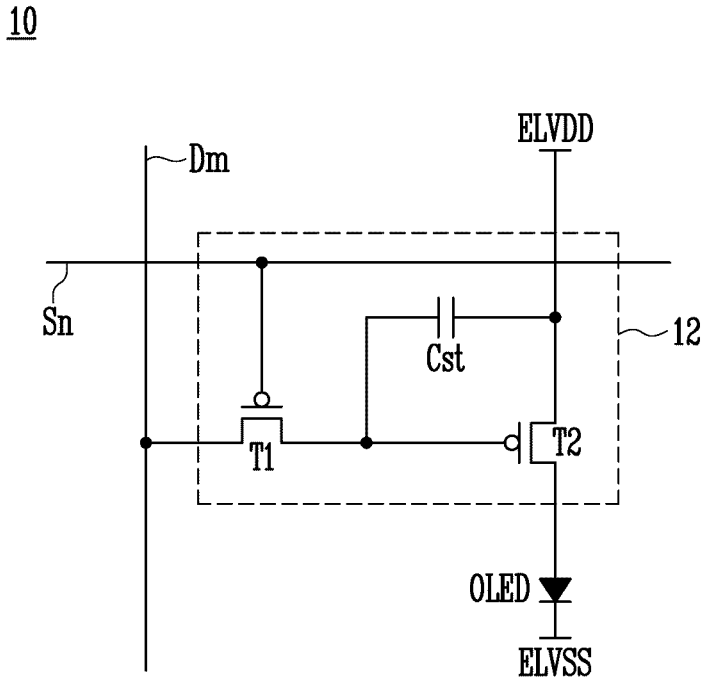
FIG. 2 is a circuit diagram showing an embodiment of a pixel shown in FIG. 1.

FIG. 2 is a circuit diagram showing an embodiment of a pixel shown in FIG. 1. Particularly, for convenience of illustration, a pixel coupled to an n-th scan line Sn and an m-th data line Dm is illustrated in FIG. 2.

Referring to FIG. 2, each pixel 10 includes an organic light emitting diode OLED, and a pixel circuit 12 coupled to the data line Dm and the scan line Sn so as to control the organic light emitting diode OLED.

An anode electrode of the organic light emitting diode OLED is coupled to the pixel circuit 12, and a cathode electrode of the organic light emitting diode OLED is coupled to the second voltage ELVSS.

The organic light emitting diode OLED generates light with a predetermined luminance, corresponding to current supplied from the pixel circuit 12.

The pixel circuit 12 controls the amount of current supplied to the organic light emitting diode OLED, corresponding to the data signal supplied to the data line Dm when the scan signal is supplied to the scan line Sn. To this end, the pixel circuit 12 includes a second transistor T2 coupled between the first voltage ELVDD and the organic light emitting diode OLED, a first transistor T1 coupled among the second transistor T2, the data line Dm and the scan line Sn, and a storage capacitor Cst coupled between a gate electrode and a first electrode of the second transistor T2.

A gate electrode of the first transistor T1 is coupled to the scan line Sn, and a first electrode of the first transistor T1 is coupled to the data line Dm.

A second electrode of the first transistor T1 is coupled to one terminal of the storage capacitor Cst.

The first electrode may be set as any one of source and drain electrodes, and the second electrode may be set as an electrode different from the first electrode. For example, if the first electrode is set as the source electrode, the second electrode is set as the drain electrode.

When the scan signal is supplied to the scan line Sn, the first transistor T1 coupled to the scan line Sn and the data line Dm is turned on to supply the data signal supplied from the data line Dm to the storage capacitor Cst. In this case, the storage capacitor Cst charges a voltage corresponding to the data signal.

The gate electrode of the second transistor T2 is coupled to one terminal of the storage capacitor Cst, and the first electrode of the second transistor T2 is coupled to the other terminal of the storage capacitor Cst and the first voltage ELVDD. A second electrode of the second transistor T2 is coupled to the anode electrode of the organic light emitting diode OLED.

The second transistor T2 controls the amount of current flowing from the first voltage ELVDD to the second voltage ELVSS via the organic light emitting diode OLED, corresponding to the voltage stored in the storage capacitor Cst. In this case, the organic light emitting diode OLED generates light corresponding to the amount of the current supplied from the second transistor T2.

The structure of the pixel described in FIG. 2 is merely one embodiment of the present invention, and therefore, the pixel 10 of the present invention is not limited to the structure thereof. Practically, the pixel circuit 12 has a circuit structure in which current can be supplied to the organic light emitting diode OLED, and may be selected to have any one of various structures.

Referring back to FIG. 1, the DC-DC converter 60 generates the first and second voltages ELVDD and ELVSS supplied to each pixel 10 by receiving an input voltage Vin supplied from a power unit 70 and converting the input voltage Vin into the first and second voltages ELVDD and ELVSS.

In this case, the first voltage ELVDD may be set as a positive voltage, and the second voltage ELVSS may be set as a negative voltage.

The power unit 70 may be a battery for supplying DC power or a rectifying device for converting AC power into DC power and outputting the DC power. However, the present invention is not limited thereto.

Figure 3:
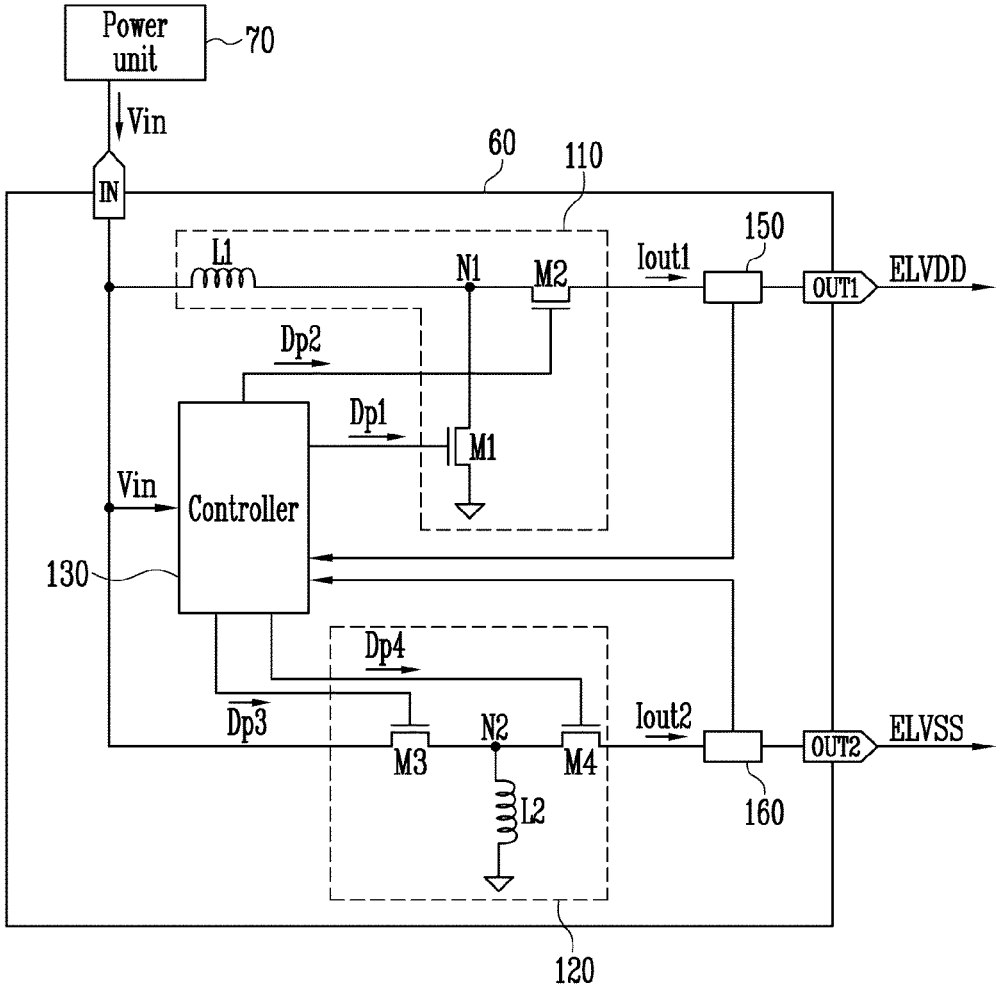
FIG. 3 is a circuit diagram showing a DC-DC converter according to an embodiment of the present invention.

FIG. 3 is a circuit diagram showing a DC-DC converter according to an embodiment of the present invention.

Referring to FIG. 3, the DC-DC converter 60 according to this embodiment includes a first voltage generator 110, a second voltage generator 120, and a controller 130.

The first voltage generator 110 receives an input voltage Vin input from the power unit 70 so as to generate the first voltage ELVDD. The first voltage generator 110 may output the first voltage ELVDD to a first output terminal OUT1.

The first voltage generator 110 may convert the input voltage Vin into the first voltage ELVDD, using an inductor and a plurality of transistors.

For example, the first voltage generator 110 may be configured to include a first inductor L1, a first transistor M1 and a second transistor M2.

The first inductor L1 may be coupled between a first node N1 and an input terminal IN to which the input voltage Vin is applied.

The first transistor M1 may be coupled between the first node N1 and ground.

The second transistor M2 may be coupled between the first node N1 and the first output terminal OUT1.

The first node N1 may be defined as a common node of the first inductor L1, the first transistor M1 and the second transistor M2.

Although in FIG. 3 both the first and second transistors M1 and M2 are N-type transistors, it will be apparent that the first and second transistors M1 and M2 may be implemented as P-type transistors in other embodiments.

In some embodiments, the first and second transistors M1 and M2 may be formed to be of different conductive types from each other. For example, in a case where the first transistor M1 is formed to be of a P-type, the second transistor M2 may be formed to be of an N-type.

The controller 130 functions to control driving of the first voltage generator 110. Specifically, the controller 130 supplies first driving pulses Dp1 and Dp2 to the transistors M1 and M2 in the first voltage generator 110, so as to control on-off operations of the transistors M1 and M2.

In order to reduce power loss by improving the conversion efficiency of the first voltage generator 110, the controller 130 may change the amplitudes of the first driving pulses Dp1 and Dp2 for controlling the transistors M1 and M2 of the first voltage generator 110.

The first driving pulses Dp1 and Dp2 may be supplied to gate electrodes of the first and second transistors M1 and M2, respectively.

Figure 4:
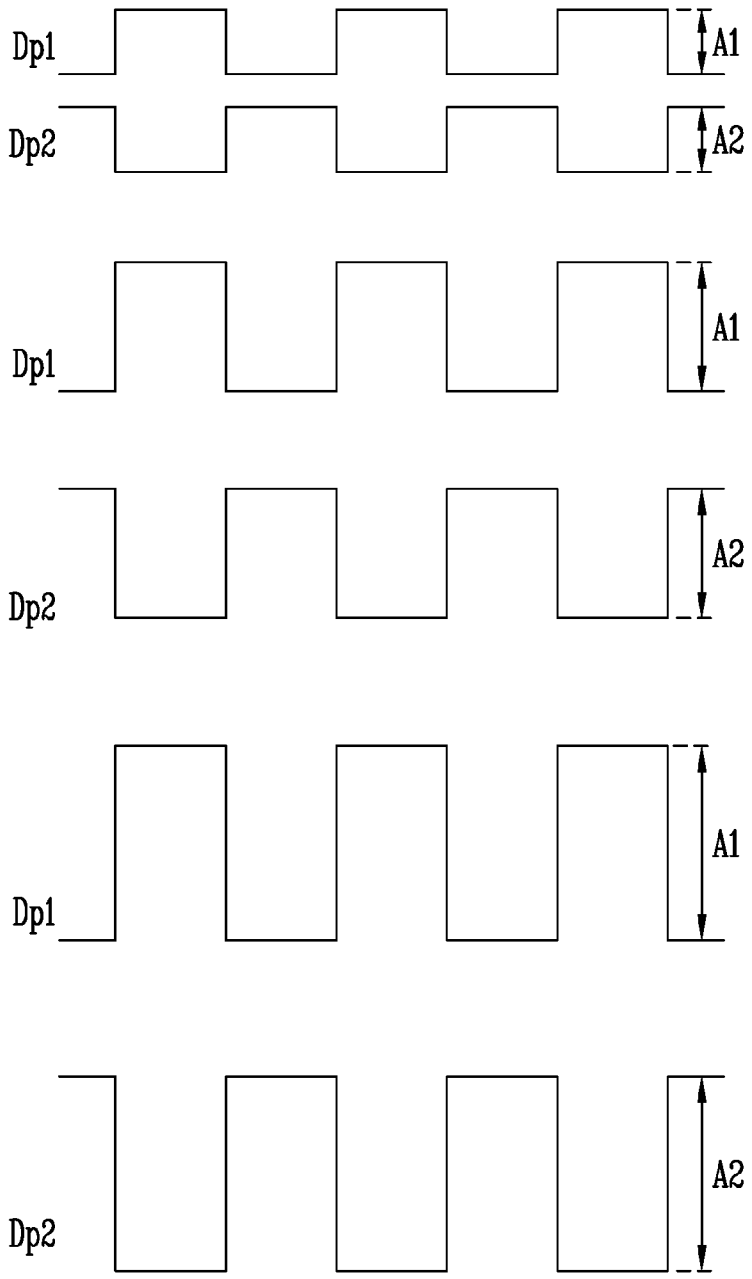
FIG. 4 is a waveform diagram illustrating a change in amplitude of a driving pulse according to an embodiment of the present invention.

FIG. 4 is a waveform diagram illustrating a change in amplitude of a driving pulse according to an embodiment of the present invention. Particularly, driving pulses Dp1 and Dp2 respectively supplied to the gate electrodes of the first and second transistors M1 and M2 are shown in FIG. 4.

Figure 5:
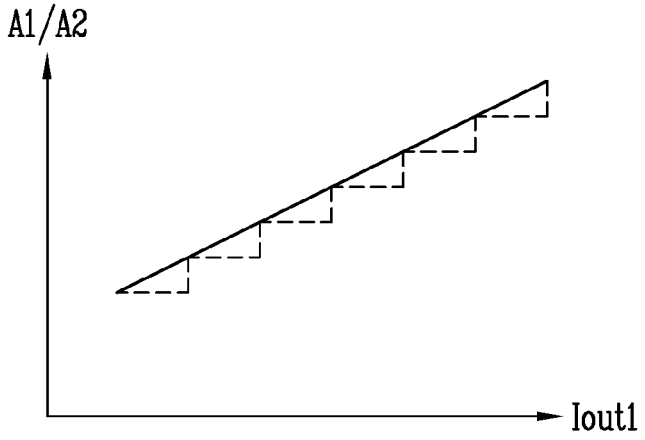
FIG. 5 is a graph showing a relationship between output current and the amplitude of the driving pulse according to an embodiment of the present invention.

FIG. 5 is a graph showing a relationship between output current and the amplitude of the driving pulse according to an embodiment of the present invention.

For convenience of illustration, the driving pulses Dp1 and Dp2 supplied to the gate electrodes of the first and second transistors M1 and M2 may be referred to as first driving pulses Dp1 and Dp2, respectively.

As shown in FIG. 4, the controller 130 may change the amplitude A1 of the driving pulse Dp1 supplied to the first transistor M1 and the amplitude A2 of the driving pulse Dp2 supplied to the second transistor M2.

The amplitude A1 of the driving pulse Dp1 supplied to the first transistor M1 and the amplitude A2 of the driving pulse Dp2 supplied to the second transistor M2 may be identical to, or different from, each other.

In order to alternately turn on the first and second transistors M1 and M2, the driving pulse Dp1 supplied to the first transistor M1 and the driving pulse Dp2 supplied to the second transistor M2 may have a phase difference of 180 degrees.

However, in a case where the first and second transistors M1 and M2 are formed to be of different conductive types from each other, both the driving pulses Dp1 and Dp2 may have the same phase.

The controller 130 may change the amplitudes A1 and A2 of the first driving pulses Dp1 and Dp2, corresponding to the output current Iout1 of the first voltage generator 110.

Referring back to FIG. 3, the DC-DC converter 60 may be provided with a first current sensor 150 for detecting the output current Iout1 output from the first voltage generator 110.

The value of the output current Iout1 detected through the first current sensor 150 may be provided to the controller 130.

The controller 130 that receives the value of the output current Iout1 from the first current sensor 150 may change the amplitudes A1 and A2 of the first driving pulses Dp1 and Dp2, based on the value of the output current Iout1.

As shown in FIG. 5, the controller 130 may linearly increase the amplitudes A1 and A2 of the first driving pulses Dp1 and Dp2 as the output current Iout1 increases.

The controller 130 may increase the amplitudes A1 and A2 of the first driving pulses Dp1 and Dp2 in a step form as the output current Iout1 increases.

The current charged/discharged by a parasitic capacitor of the transistor can be decreased by driving the transistor to a low voltage in a low output current, and the resistance of the transistor can be decreased by driving the transistor to a high voltage in a high output current, so that it is possible to achieve a higher power conversion efficiency.

The controller 130 may change the amplitudes A1 and A2 of the first driving pulses Dp1 and Dp2 by considering not only the output current Iout1 but also the input voltage Vin.

The controller 130 may determine the amplitudes A1 and A2 of the first driving pulses Dp1 and Dp2 corresponding to the detected output current Iout1 and the input voltage Vin, with reference to a predetermined table such as Table 1.

TABLE 1

| | W1 ≤ Vin < X1 | X1 ≤ Vin < Y1 | Y1 ≤ Vin < Z1 |
|---|---|---|---|
| W2 ≤ Iout1 < X2 | F(>E) | F | E |
| X2 ≤ Iout1 < Y2 | G(>F) | F | E |
| Y2 ≤ Iout1 < Z2 | G | G | G |

For example, in a case where the value of the output current Iout1 exists between X2 and Y2 that are predetermined values, and the value of the input voltage Vin exists between Y1 and Z1 that are predetermined values, the amplitude A1 of the driving pulse Dp1 supplied to the first transistor M1 may be changed into E that is a predetermined value.

The amplitude A2 of the driving pulse Dp2 supplied to the second transistor M2 may also be controlled in the same manner.

The DC-DC converter 60 according to this embodiment may further include a second voltage generator 120.

The second voltage generator 120 may generate the second voltage ELVSS by receiving the input voltage Vin from the power unit 70, and output the second voltage ELVSS to a second output terminal OUT2.

The second voltage generator 120 may change the input voltage Vin into the second voltage ELVSS, using an inductor and a plurality of transistors.

For example, the second voltage generator 120 may be configured to include a second inductor L2, a third transistor M3 and a fourth transistor M4.

The third transistor M3 may be coupled between a second node N2 and the input terminal IN to which the input voltage Vin is applied.

The fourth transistor M4 may be coupled between the second node N2 and the second output terminal OUT2.

The second inductor L2 may be coupled between the second node N2 and the ground.

The second node N2 may be defined as a common node of the second inductor L2, the third transistor M3 and the fourth transistor M4.

Although it has been illustrated in FIG. 3 that both the third and fourth transistors M3 and M4 are N-type transistors, it will be apparent that the third and fourth transistors M3 and M4 may be implemented as P-type transistors in other embodiments.

The third and fourth transistors M3 and M4 may be formed to be of different conductive types from each other. For example, in a case where the third transistor M3 is formed to be of a P-type, the fourth transistor M4 may be formed to be of an N-type.

The controller 130 may control the second voltage generator 120 in the same manner as the first voltage generator 110.

The controller 130 may control on-off operations of the transistors M3 and M4 by supplying second driving pulses Dp3 and Dp4 to the transistors M3 and M4 in the second voltage generator 120.

In order to reduce power loss by improving the conversion efficiency of the second voltage generator 120, the controller 130 may change the amplitudes of the second driving pulses Dp3 and Dp4 for controlling the transistors M3 and M4 of the second voltage generator 120.

The second driving pulses Dp3 and Dp4 may be supplied to gate electrodes of the third and fourth transistors M3 and M4, respectively.

For convenience of illustration, the driving pulses Dp3 and Dp4 supplied to the gate electrodes of the third and fourth transistors M3 and M4 may be referred to as second driving pulses Dp3 and Dp4, respectively.

The amplitude of the driving pulse Dp3 supplied to the third transistor M3 and the amplitude of the driving pulse Dp4 supplied to the fourth transistor M4 may be identical to or different from each other.

In order to alternately turn on the third and fourth transistors M3 and M4, the driving pulse Dp3 supplied to the third transistor M3 and the driving pulse Dp4 supplied to the fourth transistor M4 may have a phase difference of 180 degrees.

However, in a case where the third and fourth transistors M3 and M4 are formed to be of different conductive types from each other, both the driving pulses Dp3 and Dp4 may have the same phase.

The controller 130 may change the amplitudes of the second driving pulses Dp3 and Dp4, corresponding to the output current Iout2 of the second voltage generator 120.

The DC-DC converter 60 may be provided with a second current sensor 160 for detecting the output current Iout2 output from the second voltage generator 120.

The value of the output current Iout2 detected through the second current sensor 160 may be provided to the controller 130.

The controller 130 that receives the value of the output current Iout2 from the second current sensor 160 may change the amplitudes of the second driving pulses Dp3 and Dp4, based on the value of the output current Iout2.

The controller 130 may increase the amplitudes of the second driving pulses Dp3 and Dp4 in a linear or step form as the output current Iout2 increases.

The controller 130 may change the amplitudes of the second driving pulses Dp3 and Dp4 by considering not only the output current Iout2 but also the input voltage Vin.

The method in which the controller 130 changes the amplitudes of the second driving pulses Dp3 and Dp4 is the same as that in which the controller 130 changes the first driving pulses Dp1 and Dp2, and therefore, its detailed description will be omitted.

Figure 6:
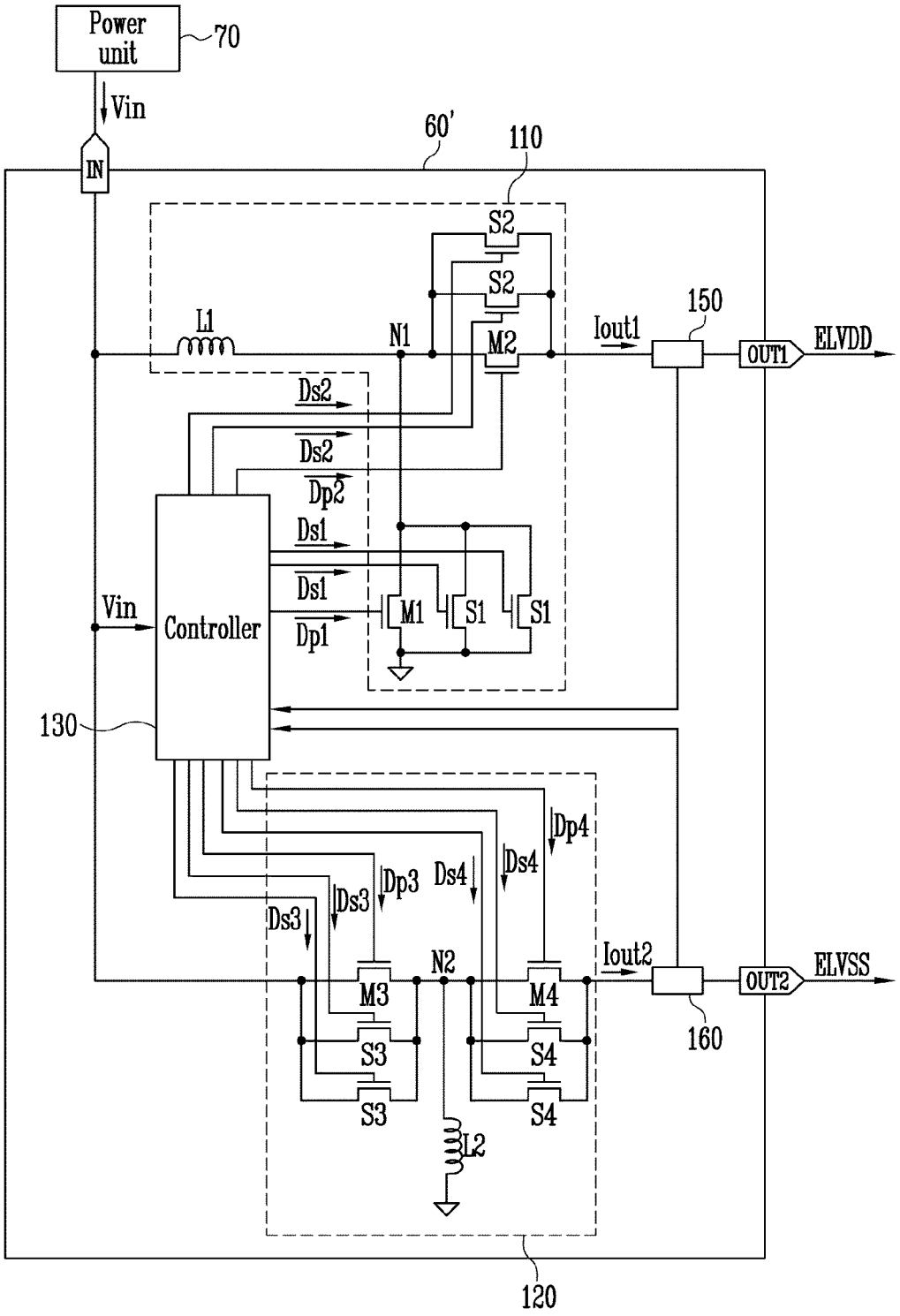
FIG. 6 is a circuit diagram showing a DC-DC converter according to another embodiment of the present invention.

FIG. 6 is a circuit diagram showing a DC-DC converter according to another embodiment of the present invention.

Referring to FIG. 6, the first voltage generator 110 of the DC-DC converter 60' may further include two first auxiliary transistors S1 and two second auxiliary transistors S2.

The two first auxiliary transistors S1 are coupled in parallel to the first transistor M1.

The first auxiliary transistors S1 may be coupled between the first node N1 and ground so as to be coupled in parallel to the first transistor M1.

Although FIG. 6 illustrates only two first auxiliary transistors S1 are provided as an example, more than two first auxiliary transistors S1 may be included in other embodiments.

The two second auxiliary transistors S2 are coupled in parallel to the second transistor M2.

The second auxiliary transistors S2 may be coupled between the first node N1 and the first output terminal OUT1 so as to be coupled in parallel to the second transistor M2.

Although FIG. 6 illustrates only two second auxiliary transistors S2 are provided as an example, the more than two second auxiliary transistors S2 may be included in other embodiments.

Like the first and second transistors M1 and M2, the on-off operations of the first and second auxiliary transistors S1 and S2 may be controlled by the controller 130.

The controller 130 may control the first and second auxiliary transistors S1 and S2 by respectively supplying driving pulses Ds1 and Ds2 to gate electrodes of the first and second auxiliary transistors S1 and S2.

In order to improve the power conversion efficiency, when necessary, the controller 130 may select at least one of the first transistor M1 and the first auxiliary transistors S1 and drive the selected transistor(s), and may select at least one of the second transistor M2 and the second auxiliary transistors S2 and drive the selected transistor(s).

The controller 130 may determine the number of transistors to be driven, in consideration of the output current Iout1 of the first voltage generator 110.

For example, in a case where the output current Iout1 increases, both the first transistor M1 and the first auxiliary transistor S1 may be driven, and both the second transistor M2 and the second auxiliary transistor S2 may also be driven, in order to reduce resistance loss.

In a case where the output current Iout1 is low, the first and second auxiliary transistors S1 and S2 may be set to be in a turned-off state, and only the first and second transistors M1 and M2 may be driven.

Alternatively, the first and second transistors M1 and M2 may be set to be in a turned-off state, and only the first and second auxiliary transistors S1 and S2 may be driven.

The second voltage generator 120 may further include two third auxiliary transistors S3 and two fourth auxiliary transistors S4.

The two third auxiliary transistors S3 are coupled in parallel to the third transistor M3.

The third auxiliary transistors S3 may be coupled between the input terminal IN and the second node N2 so as to be coupled in parallel to the third transistor M3.

Although FIG. 6 illustrates two third auxiliary transistors S3 are provided as an example, the more than two auxiliary transistors S3 may be included in other embodiments.

The fourth auxiliary transistors S4 are coupled in parallel to the fourth transistor M4.

The fourth auxiliary transistors S4 may be coupled between the second node N2 and the second output terminal OUT2 so as to be coupled in parallel to the fourth transistor M4.

Although FIG. 6 illustrates two fourth auxiliary transistors S4 are provided as an example, the more than two auxiliary transistors S4 may be included in other embodiments.

Like the third and fourth transistors M3 and M4, the on-off operations of the third and fourth auxiliary transistors S3 and S4 may be controlled by the controller 130.

The controller 130 may control the third and fourth auxiliary transistors S3 and S4 by respectively supplying driving pulses Ds3 and Ds4 to gate electrodes of the third and fourth auxiliary transistors S3 and S4.

In order to improve the power conversion efficiency, when necessary, the controller 130 may select at least one of the third transistor M3 and the third auxiliary transistors S3 and drive the selected transistor(s), and may select at least one of the fourth transistor M4 and the fourth auxiliary transistors S4 and drive the selected transistor(s).

The controller 130 may determine the number of transistors to be driven, in consideration of the output current Iout2 of the second voltage generator 120.

For example, in a case where the output current Iout2 increases, both the third transistor M3 and the third auxiliary transistor S3 may be driven, and both the fourth transistor M4 and the fourth auxiliary transistor S4 may also be driven, in order to reduce resistance loss.

In a case where the output current Iout2 is low, the third and fourth auxiliary transistors S3 and S4 may be set to be in a turned-off state, and only the third and fourth transistors M3 and M4 may be driven.

Alternatively, the third and fourth transistors M3 and M4 may be set to be in a turned-off state, and only the third and fourth auxiliary transistors S3 and S4 may be driven.

While the present invention has been described in connection with certain embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A DC-DC converter, comprising:

a first voltage generator comprising a first inductor and a first plurality of transistors, the first voltage generator configured to convert an input voltage into a first voltage and to output the first voltage to a first output terminal;

a second voltage generator comprising a second inductor and a second plurality of transistors, the second voltage generator configured to convert the input voltage into a second voltage and to output the second voltage to a second output terminal; and a controller configured to control driving of the first voltage generator by supplying a first driving pulse to each transistor of the first voltage generator, and control driving of the second voltage generator by supplying a second driving pulse to each transistor of the second voltage generator;

wherein an amplitude of the first driving pulse is adjustable based on a first current output from the first voltage generator, wherein an amplitude of the second driving pulse is adjustable based on a second current output from the second voltage generator; and wherein the first output terminal and the second output terminal are not connected to one another.

2. The DC-DC converter according to claim 1, wherein the first voltage generator comprises:

a first inductor coupled between a first node and an input terminal to which the input voltage is applied;

a first transistor coupled between the first node and ground; and a second transistor coupled between the first node and the first output terminal.

3. The DC-DC converter according to claim 2, wherein the first driving pulse is supplied to each of the gate electrodes of the first and second transistors, respectively.

4. The DC-DC converter according to claim 2, wherein the first voltage generator further comprises:

at least one first auxiliary transistor coupled in parallel to the first transistor; and at least one second auxiliary transistor coupled in parallel to the second transistor.

5. The DC-DC converter according to claim 4, wherein the controller is configured to select at least one of the first transistor and the at least one first auxiliary transistor and to drive the selected transistor, and configured to select at least one of the second transistor and the at least one second auxiliary transistor and to drive the selected transistor.

6. The DC-DC converter according to claim 1, wherein the controller is further configured to change the amplitude of the first driving pulse, based on the input voltage.

7. The DC-DC converter according to claim 1, wherein the second voltage generator comprises:

a third transistor coupled between a second node and the input terminal to which the input voltage is applied;

a fourth transistor coupled between the second node and the second output terminal; and a second inductor coupled between the second node and ground.

8. The DC-DC converter according to claim 7, wherein the second driving pulse is supplied to each of the gate electrodes of the third and fourth transistors, respectively.

9. The DC-DC converter according to claim 7, wherein the second voltage generator further comprises:

at least one third auxiliary transistor coupled in parallel to the third transistor; and at least one fourth auxiliary transistor coupled in parallel to the fourth transistor.

10. The DC-DC converter according to claim 9, wherein the controller is configured to select at least one of the third transistor and the at least one third auxiliary transistor and to drive the selected transistor, and configured to select at least one of the fourth transistor and the at least one fourth auxiliary transistor and to drive the selected transistor.

11. The DC-DC converter according to claim 1, wherein the controller is further configured to change the amplitude of the second driving pulse, based on the input voltage.

12. The DC-DC converter according to claim 1, wherein the first voltage is a positive voltage and the second voltage is a negative voltage.

13. An organic light emitting display, comprising:

a plurality of pixels coupled to scan lines and data lines;

a scan driver configured to supply a scan signal to the pixels through the scan lines;

a data driver configured to supply a data signal to the pixels through the data lines; and a DC-DC converter configured to supply first and second voltages to the pixels, wherein the DC-DC converter comprises:

a first voltage generator comprising a first inductor and a first plurality of transistors, the first voltage generator configured to convert an input voltage into a first voltage and to output the first voltage to a first output terminal;

a second voltage generator comprising a second inductor and a second plurality of transistors, the second voltage generator configured to convert the input voltage into a second voltage and to output the second voltage to a second output terminal; and a controller configured to:

control driving of the first voltage generator by supplying a first driving pulse to each transistor of the first voltage generator, and control driving of the second voltage generator by supplying a second driving pulse to each transistor of the second voltage generator;

wherein an amplitude of the first driving pulse is adjustable based on a current output from the first voltage generator, wherein an amplitude of the second driving pulse is adjustable based on a second current output from the second voltage generator; and wherein the first output terminal and the second output terminal are not connected to one another.

14. The organic light emitting display according to claim 13, wherein the first voltage generator comprises:

a first inductor coupled between a first node and an input terminal to which the input voltage is applied;

a first transistor coupled between the first node and ground; and a second transistor coupled between the first node and the first output terminal.

15. The organic light emitting display according to claim 14, wherein the controller is further configured to change the amplitude of the first driving pulse, based on the input voltage.

16. The organic light emitting display according to claim 15, wherein the first driving pulse is supplied to each of the gate electrodes of the first and second transistors, respectively.

17. The organic light emitting display according to claim 14, wherein the first voltage generator further comprises:

at least one first auxiliary transistor coupled in parallel to the first transistor; and at least one second auxiliary transistor coupled in parallel to the second transistor.

18. The organic light emitting display according to claim 13, wherein the second voltage generator comprises:

a third transistor coupled between a second node and the input terminal to which the input voltage is applied;

a fourth transistor coupled between the second node and the second output terminal; and a second inductor coupled between the second node and ground.

19. The organic light emitting display according to claim 18, wherein the controller is configured to select at least one of the third transistor and the at least one third auxiliary transistor and to drives the selected transistor, and configured to select at least one of the fourth transistor and the at least one fourth auxiliary transistor and to drive the selected transistor.

20. The organic light emitting display according to claim 13, wherein the controller is further configured to change the amplitude of the second driving pulse, based on the input voltage.

21. The organic light emitting display according to claim 13, wherein the second driving pulse is supplied to each of the gate electrodes of the third and fourth transistors, respectively.

22. The organic light emitting display according to claim 13, wherein the second voltage generator further comprises:

at least one third auxiliary transistor coupled in parallel to the third transistor; and at least one fourth auxiliary transistor coupled in parallel to the fourth transistor.

23. The organic light emitting display according to claim 13, wherein the controller is configured to select at least one of the first transistor and the at least one first auxiliary transistor and to drive the selected transistor, and configured to select at least one of the second transistor and the at least one second auxiliary transistor and to drive the selected transistor.

24. The organic light emitting display according to claim 13, wherein the first voltage is a positive voltage and the second voltage is a negative voltage.

* * * * *